United States Patent [19]

Rigal

[11] Patent Number: 5,056,810

[45] Date of Patent: Oct. 15, 1991

[54] SAFETY SKI BINDING

[75] Inventor: Jean-Pierre Rigal, La Balme de Sillingy, France

[73] Assignee: Salomon S.A., Annecy Cedex, France

[21] Appl. No.: 475,168

[22] Filed: Feb. 5, 1990

[30] Foreign Application Priority Data

Feb. 9, 1989 [FR] France ..... 89 01696

[51] Int. Cl.[5] ..... A63C 9/08

[52] U.S. Cl. ..... 280/625; 16/355; 280/629

[58] Field of Search ..... 16/260, 268, 269, 355, 16/362, 363; 280/626, 627, 628, 631, 632, 623, 625, 630, 629; 403/161, 353, 375

[56] References Cited

U.S. PATENT DOCUMENTS

| | | | |
|---|---|---|---|
| 3,408,087 | 10/1968 | Ramillon | 280/631 |
| 3,778,075 | 12/1973 | Droz et al. | 280/628 |
| 3,781,029 | 12/1973 | Salomon | 280/628 |
| 4,123,822 | 11/1978 | Bentley | 16/355 |
| 4,218,071 | 8/1980 | Salomon | 280/630 |
| 4,356,958 | 8/1985 | Yosi | 16/363 X |
| 4,554,700 | 11/1985 | Lyman | 16/363 X |
| 4,824,162 | 4/1989 | Geisler et al. | 16/269 X |
| 4,832,394 | 5/1989 | Macomber | 16/355 X |

FOREIGN PATENT DOCUMENTS

| | | | |
|---|---|---|---|
| 3612697 | 11/1986 | Fed. Rep. of Germany . | |
| 2105550 | 4/1972 | France | 280/628 |
| 2385418 | 10/1978 | France . | |
| 586580 | 3/1987 | France . | |
| 243533 | 1/1947 | Switzerland | 16/363 |
| 525687 | 9/1972 | Switzerland . | |

OTHER PUBLICATIONS

A copy of the French Search Report.

*Primary Examiner*—Andres Kashnikow
*Assistant Examiner*—Michael Mar
*Attorney, Agent, or Firm*—Sandler, Greenblum & Bernstein

[57] ABSTRACT

A ski binding adapted to hold an end of a boot upon a ski. The binding includes a jaw and a body, in whyich the body of the binding further includes a lower part adapted to be affixed to the ski and having an upwardly facing surface extending upwardly and toward an end of the body, and an upper part which supports the jaw and having a downwardly facing surface for being positioned adjacent the upwardly facing surface of the lower part, wherein the upwardly facing surface of the lower part and the downwardly facing surface of the upper part are complementarily arcuately shaped having a common center of curvature, when the upwardly facing surface of the lower part is positioned adjacent the downwardly facing surface of the upper part, for enabling a generally pivotal movement of the upper part with respect to the lower part about the center of curvature.

31 Claims, 3 Drawing Sheets

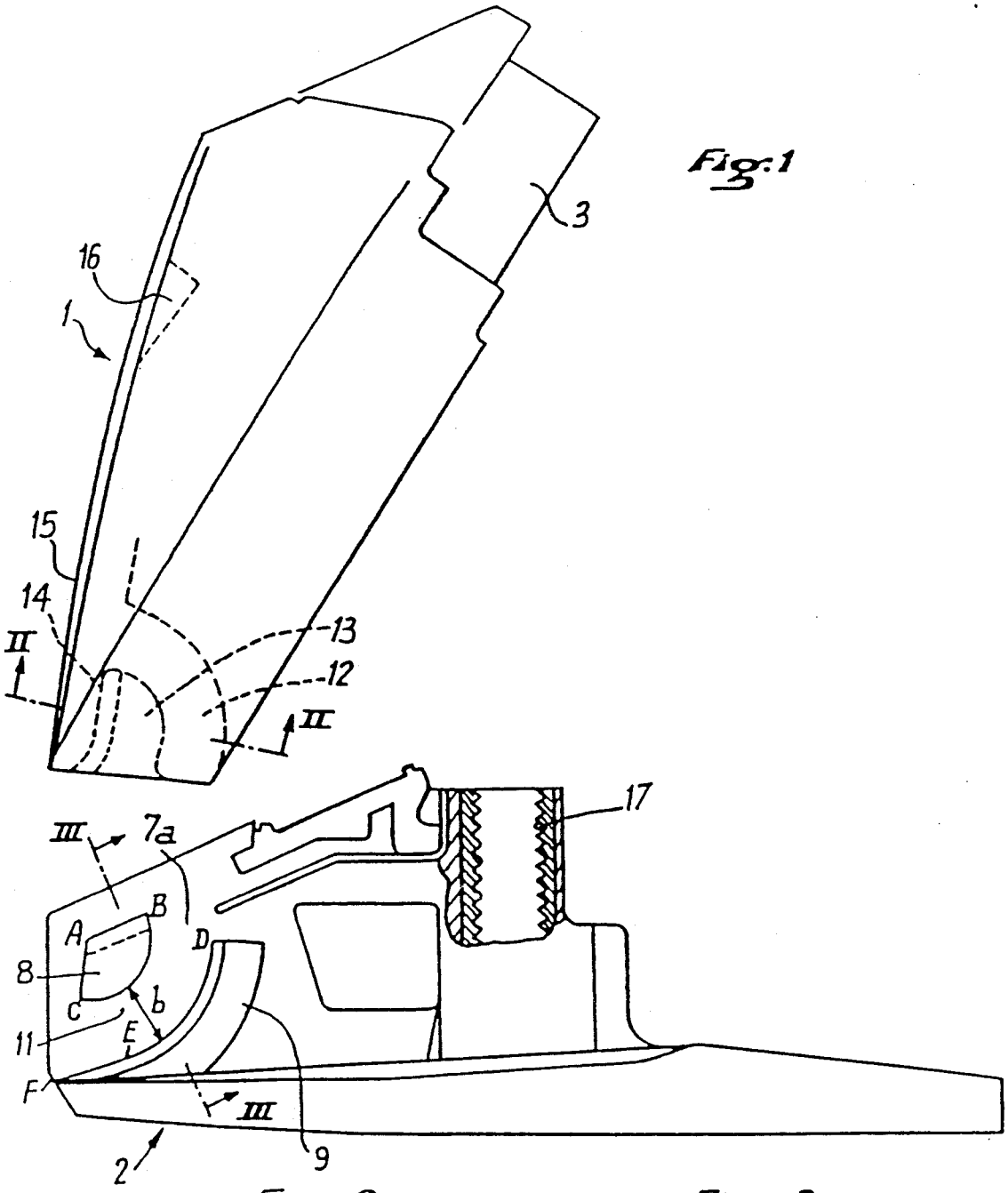
Fig: 1
Fig: 2
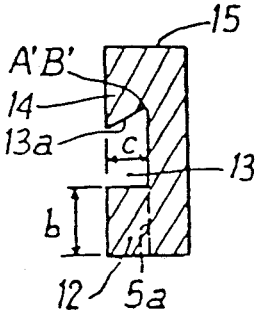
Fig: 3
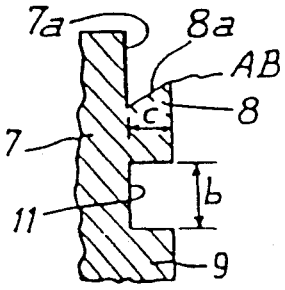

SAFETY SKI BINDING

BACKGROUND OF THE INVENTION

1. Field of the Invention

The present invention relates to a safety ski binding, preferably adapted to hold the front of a boot onto a ski.

2. Description of Background and Other Information

Safety ski bindings, specifically front abutments of the aforementioned type generally comprise a body fixed to the ski which supports, in a rear part, a movable jaw which is either of monoblock construction or comprises two independent lateral retention wings which are journalled, respectively, on the binding body by means of individual axes.

The binding body of a front abutment of the type mentioned is typically constituted by two parts nested in one another at the front, namely, a lower part or base which is affixed to the ski and an upper movable part which supports the jaw The body likewise contains a mechanism for energization of the jaw, which is constituted by an energization spring and a force transmission device. The upper part of the body which supports the jaw is vertically upwardly movable during a rear fall which can cause, by means of a rear fall compensation device known per se, a lessening of the lateral release, i.e., a lowering of the lateral force threshold, exerted by the boot on one of the lateral retention wings, from which the binding releases The upward movement of the upper part of the body can ultimately lead to the release of the boot when the upward angular clearance of the upper part of the body is sufficient. In front abutments of this type, the journalling between the upper part of the body, which is vertically movable, and the lower base affixed to the ski is achieved by means of a transverse horizontal journal axle which extends completely through these two elements, or even two transverse and coaxial half-axles which establish the linkage between the lateral adjacent surfaces of the upper part of the body and those of the base, respectively.

A front abutment of this type is described for example, in German Patent No. 3,612,697. In such a front abutment, the journal axle of the upper part of the body on the base has a relatively small diameter, whereas the forces that this axle transmit are relatively great. These forces are due to the thrust of the rear binding to which are added those which are due to the flexion of the ski, during skiing, the sum of these forces being able to reach 200daN [decaNewton]. As a result, an axle of small diameter generates between its exterior surface and the surface of its support greatly elevated contact pressures which create a rapid wear-and-tear leading, in turn, to a certain amount of play and an inferior functioning of the binding. In addition, there can result a distortion of the axle or even a defect in alignment of the two opposed transverse half-axles, which is due to the elevated stresses during use of the binding.

SUMMARY OF THE INVENTION

The present invention aims to overcome the aforementioned disadvantages by providing a ski binding adapted to hold an 20 end of a boot upon a ski, the binding comprising:

(a) a jaw; and (b) a body comprising:

(i) a lower part adapted to be affixed to the ski and having a first end, a second end, and a longitudinal axis, the lower part further having an upwardly facing surface extending upwardly and toward the second end; and (ii) an upper part for supporting the jaw and having a first end, a second end, and a longitudinal axis, the upper part having a downwardly facing surface for being positioned adjacent the upwardly facing surface of the lower part, wherein the upwardly facing surface of the lower part and the downwardly facing surface of the upper part are complementarily arcuately shaped having a common center of curvature, when the upwardly facing surface of the lower part is positioned adjacent the downwardly facing surface of the upper part, for enabling a generally pivotal movement of the upper part with respect to the lower part about the center of curvature.

In a specific aspect of the invention, the upwardly facing surface of the lower part terminates at a location spaced from the center of curvature in a direction toward the second end of the lower part.

More particularly, the lower part includes a generally vertical surface on either side of the longitudinal axis of the lower part, one of the generally vertical surfaces of the lower part having affixed thereto the upwardly facing surface, the other of the generally vertical surfaces of the lower part having affixed thereto another upwardly facing surface, wherein each of the generally vertical surfaces of the lower part further has affixed thereto a projection, wherein each of the projections is positioned above a respective one of the upwardly facing surface and the another upwardly facing surface to define a respective groove.

Still further, the upper part includes a generally vertical surface on either side of the longitudinal axis of the upper part, one of the generally vertical surfaces of the upper part having affixed thereto the downwardly facing surface, the other of the generally vertical surfaces of the upper part having affixed thereto another downwardly facing surface, wherein each of the generally vertical surfaces of the upper part further has a recess therein, wherein each of the recesses is positioned radially inwardly from a respective one of the downwardly facing surfaces toward the center of curvature to thereby define respective arc-shaped ribs for being slidingly receivable in a respective one of the grooves in the lower part.

Still further according to the invention, the generally vertical surfaces of the upper part include inner surfaces of respective parallel lateral arms, each of which is adapted to be positioned exteriorly of respective generally vertical surfaces of the lower part and to slide relative thereto during the general pivoting movement of the upper part with respect to the lower part.

Still further according to the invention, each of the projections and the recesses have complementarily shaped arcuate surfaces generally centered at the center of curvature.

Still further according to the invention, each of the projections extend transversely outwardly from a respective generally vertical surface and ends in a widened portion, and each of the recesses extend transversely inwardly from a respective generally vertical surface and ends in a widened portion for receiving a respective widened portion of a respective one of the projections.

Still further according to the invention, the upper part and the lower part of the body are further coupled by means of a height adjustment screw for selective adjustment of the height of the jaw relative to the ski.

It is a further object of the invention to provide a safety ski binding adapted to hold the front of a boot mounted on a ski, including:

(a) a jaw adapted to engage a portion of the boot and adapted to be biased to a predetermined position by means of a biasing mechanism comprised of a spring and an element for transmitting force from the spring to the jaw; and (b) a body including:

(i) a lower part adapted to be affixed to the ski and having a front end and a rear end; and (ii) an upper part, the upper part supporting the jaw and having a front end and a rear end, the upper part being movable with respect to the lower part about a generally horizontal transverse axis extending through the front end of the lower part and the front end of the upper part, wherein respective portions of the upper part and the lower part are nested with respect to one another by means of respective generally vertical surfaces of the upper part and the lower part laterally adjacent each other, wherein the respective vertical surfaces of the upper part and the lower part of the body support projecting elements and hollow elements having respective complementary shapes for respective engagement in one another.

According to a further aspect of the invention, the projecting elements and the hollow elements include, (1) on one of the upper part and the lower part of the body, (A) a projection in the form of a sector of a circle, generally centered on the axis, the sector thereby having a radius of curvature and an arc of the circle, the projection thereby having an arc-shaped edge, and (B) a first arc-shaped rib in the form of an annular segment having an average radius greater than the radius of the sector and generally centered on the axis, so as to define between the first arc-shaped rib and the projection a first groove in the form of an annular segment, generally centered on the axis, and, (2) on the other of the upper part and the lower part of the body, (A) a second arc-shaped rib in the form of an annular segment generally having the same width and radius as the first groove, the second arc-shaped rib being generally centered on the axis, and (B) an upper hollow in the form of a sector of a circle, complementary in shape to the projection, defined by the second arc-shaped rib and generally centered on the axis.

According to a specific feature of the invention, the first arc-shaped rib is positioned beneath the projection and the second arc-shaped rib is positioned beneath the hollow.

Further according to the invention, the projection and the hollow have upper surfaces which extend generally perpendicularly from the generally vertical surfaces of the upper part and the lower part of the body.

In a particular embodiment of the invention, the projection and the hollow have upper surfaces which extend at an angle less than 90° from the generally vertical surfaces of the upper part and the lower part of the body so as to constitute dovetailed assemblies.

More particularly according to the invention, the projection includes, in elevation, (1) an upper rectilinear side inclined upwardly and rearwardly with respect to the horizontal, (2) a lower side including the arc-shaped edge of the projection, the arc-shaped edge extending over an angle of approximately 120°, downwardly and frontwardly, and (3) a front side which is inclined upwardly and frontwardly, and forming an angle of approximately 20° with respect to the vertical. The first arc-shaped rib has an upper surface facing the upper projection, the upper surface of the first arc-shaped rib being constituted by an arc of a circle which is generally centered at the axis and which extends over an angle slightly less than 90°. The arc of the circle of the first arc-shaped rib has an upper extremity located substantially at a height substantially the same as the axis and offset rearwardly from the axis, and the arc of the circle of the first arc-shaped rib has a lower extremity located slightly rearwardly of a vertical plane passing through the axis.

Further, the hollow includes, in elevation, an upper rectilinear edge, a lower edge in the form of an arc of a circle having a center generally at the axis, the edge extending to a frontal surface of one of the upper part and the lower part of the body into which the hollow opens, the arc of the lower edge of the upper hollow having a radius of curvature generally equal to the radius of the arc of the sector of the circle of the projection, wherein the circle of the arc of the lower edge of the hollow has a center which is positioned so as to generally coincide with the center of the circle of the arc of the lower edge of the projection when the upper part and the lower part of the body are assembled, and wherein the second arc-shaped rib is defined by an upper edge merged with the lower arc-shaped edge of the hollow and by a lower arc-shaped edge having a center of curvature generally at the axis and having a radius of curvature generally equal to the radius of curvature of the arc constituting the upper edge of the first arc-shaped rib.

BRIEF DESCRIPTION OF THE DRAWINGS

The above and additional objects, characteristics, and advantages of the present invention will become apparent in the following detailed description of the preferred embodiments, with reference to the accompanying drawings, which are presented as a non-limiting example, in which:

FIG. 1 is a side elevation view, partially in section, of a front abutment according to the invention whose two parts are shown separated and presented in relative position in view of their assembly;

FIG. 2 is a transverse sectional view taken along line II—II of FIG. 1;

FIG. 3 is a transverse sectional view taken along line III—III of FIG. 1;

DETAILED DESCRIPTION OF THE PREFERRED EMBODIMENTS

The present invention provides a journalling between the upper movable part of the body of the front abutment and the base, which is achieved by relatively simple means, ensuring a large contact surface and, consequently, a reduction in the contact pressure, without resorting to an axle having a small diameter.

To that end, the safety ski binding according to the present invention is preferably adapted to hold the front of a boot affixed to the ski, the binding comprising a body which supports, in its rear part, a movable jaw and which likewise contains an energization mechanism for the jaw, which is constituted by an energization spring and a device for transmission of force, the body being contributed by two parts which are movable with respect to one another about a generally horizontal and transverse axis located in the front of the body. The body of the binding includes a movable upper part, supporting the retention jaw, and a lower part or base which is affixed to the ski, the two upper and lower parts of the body being nested in one another in the front portion of the binding at lateral and vertical adjacent surfaces. According to the present invention, the lateral adjacent surfaces of the upper and lower parts of the body support the projecting and hollow elements, of complementary shapes, engaged respectively in one another while defining an imaginary horizontal and transverse journal axis between the two parts of the body.

With specific reference to the drawings, the front abutment shown in adapted to hold the front of a boot on a ski. This front abutment comprises a body constituted of two parts, namely an upper movable part 1, and a lower part or base 2 which is affixed to the ski by an appropriate means, for example, by screws. The upper movable part 1 is constituted by a molded piece supporting, at the rear, a retention jaw 3 which can be of monoblock construction, or have independent, movable, lateral retention wings. The jaw 3 is energized, when the front abutment is mounted in the position shown in FIG. 8, by means of an energization mechanism, not shown, lodged in base 2. The binding of the present invention, and the particular configuration of jaw and energization mechanism contemplated for the present invention is generally like that disclosed in copending, commonly assigned U.S. patent application Ser. No. 07/508,463, filed Apr. 13, 1990, the disclosure of which is hereby incorporated by reference thereto.

Figure 4:
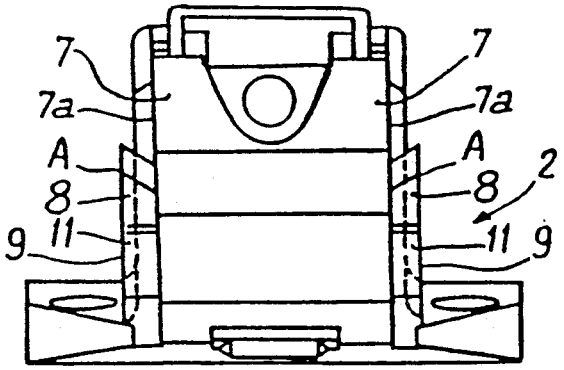
FIG. 4 is a front elevation view of the base of the body of the front abutment.
Figure 5:
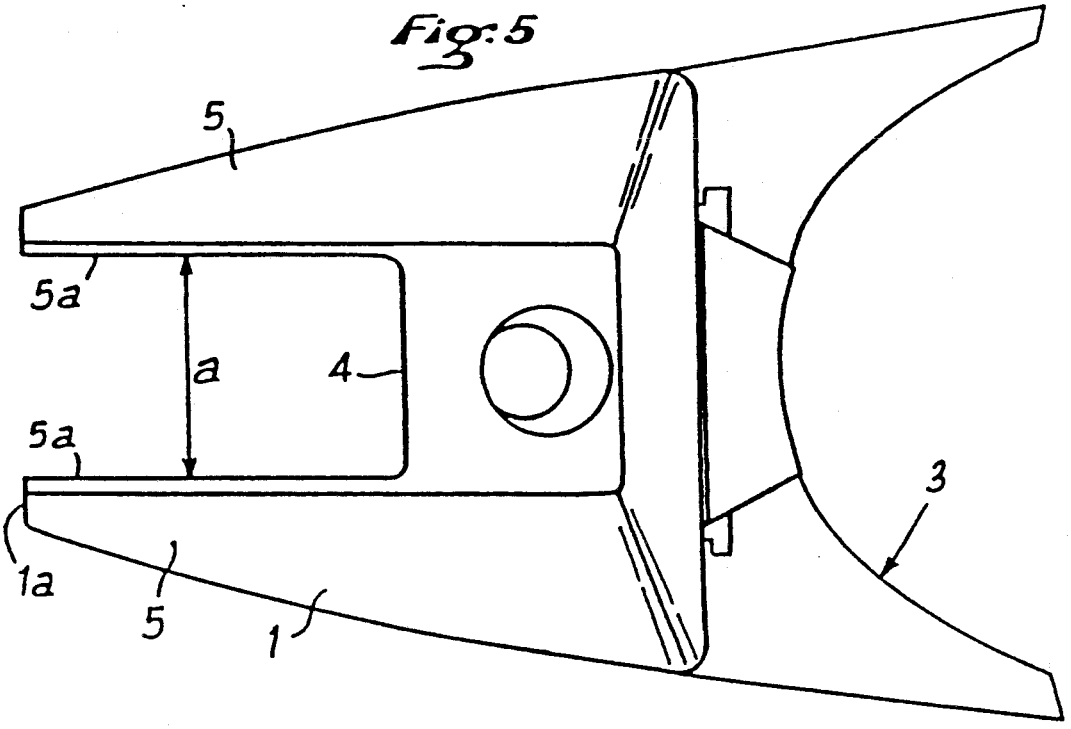
FIG. 5 is a plan view of the upper movable part of the body.

According to the invention, the movable upper part 1 is journalled, in the front, on the front of base 2, about an imaginary transverse axis A which is not constituted by a cylindrical rod of small diameter, as in the case of front abutments known in the art until now. The journal between the two parts 1 and 2 is in fact achieved by the mutual nesting of projecting and hollow elements provided on the adjacent lateral walls of the two parts 1, 2. As can be seen in FIG. 5, the upper movable part 1 of the body of the front abutment includes, in the front, a longitudinal opening 4 which opens into the anterior frontal surface 1*a* of the upper part 1 and which thus defines, in the molded piece constituting the upper part 1, two generally parallel lateral arms 5. Each of the lateral arms 5 is defined by an internal lateral surface 5*a* which constitutes a longitudinal surface of central opening 4. In the central opening 4 is tightly engaged, when the front abutment is mounted, the base 2 which is likewise constituted by a molded piece and which includes, in its anterior part, two generally vertical lateral walls 7. To ensure this tight nesting, the distance a between the external surfaces 7*a* of vertical lateral walls 7 of base 2, as shown in FIG. 4, is equal to the distance between the internal lateral surfaces 5*a* of arms 5 of the movable upper part 1, as shown in FIG. 5.

According to the invention, to achieve the journalling of the movable upper part 1 on base 2, on the external surface 7*a* of each lateral wall 7 of base 2, a projection 8 is provided in the form of a circle sector and an arc-shaped rib 9 which is located behind and beneath projection 8 The projection 8 in the form of a circle sector and the arc-shaped rib 9 are both centered on a single point A through which the imaginary transverse journal axis of the two parts 1, 2 of the body of the front abutment pass, once assembled. The projection 8 in the form of a circle sector includes, as shown in elevation in FIG. 1, an upper rectilinear side AB inclined from bottom to top and from front to rear with respect to the horizontal, a lower side BC in the form of an arc of a circle having center A, extending over an angle of approximately 120°, downwardly and frontwardly, and a front side AC which is inclined from top to bottom and from rear to front, while forming an angle of approximately 20° with respect to the vertical. Moreover, rib 9 has an upper surface, i.e. turned towards the projection 8, which is constituted by an arc of a circle DE which is centered at point A and which extends over an angle slightly less than 90°. The center of curvature D of arc DE is located substantially at the same height as the imaginary journal axis A, while being offset towards the rear, while the end E of arc DE is located slightly rearwardly of the vertical plane passing through the imaginary journal axis A. Arc DE extends towards the front by a rectilinear part EF extending downwardly. Thus, it can be seen that the upper projection 8 and the lower rib 9 defining between them a groove 11 of width b, in the form of an annular segment centered on the imaginary journal axis A.

Figure 6:
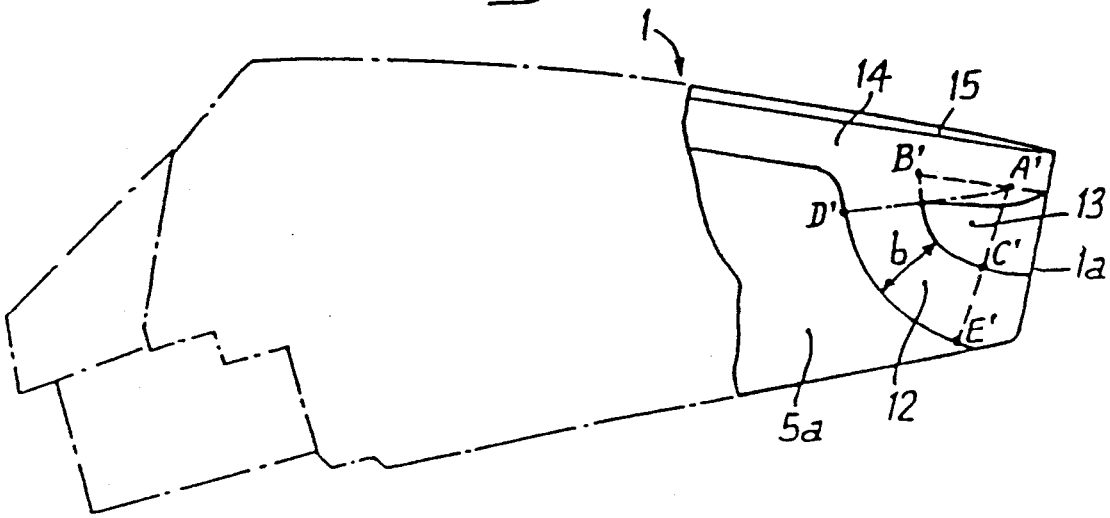
FIG. 6 is an elevation view of the front part of an internal lateral surface of the upper movable part of the body
Figure 8:
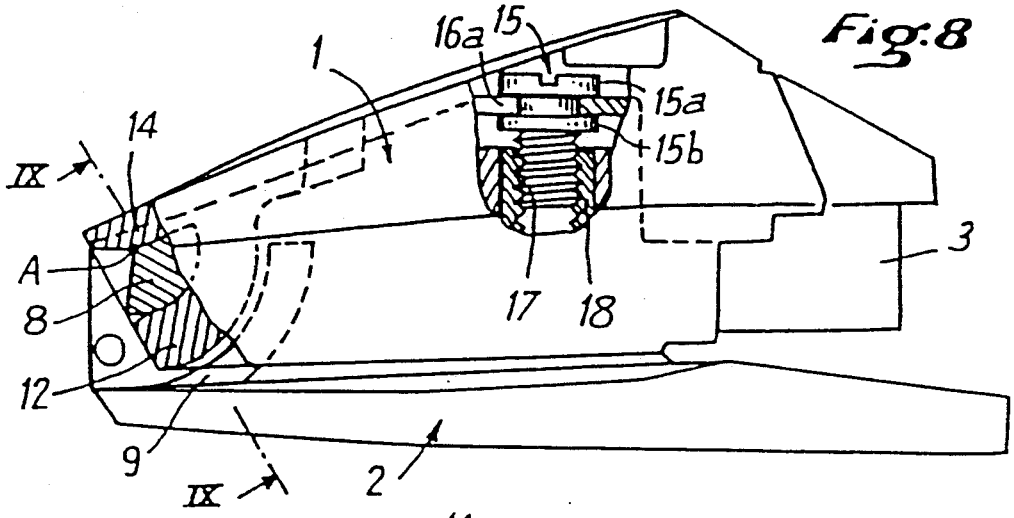
Figure 9:
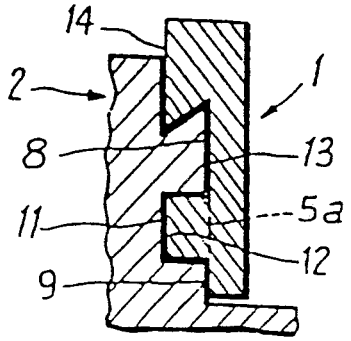
FIG. 9 is a transverse sectional view made along line IX—IX of FIG. 8.

Each lateral arm 5 of the movable upper part 1 has, on the front part of its internal lateral surface 5*a*, hollow and projecting elements which have shapes complementary to those of the elements provided on the external surface 7*a* of lateral wall 7 of base 2. More particularly, as can best be seen in FIG. 6, each internal lateral surface 5*a* has, near the anterior frontal surface 1*a*, an arc-shaped rib 12, in the form of an annular segment, which extends downwardly between an anterior and upper hollow part 13 and the remainder of the internal lateral surface 5*a*. The arc-shaped rib 12 is connected to an upper rectilinear rib 14 which follows the upper surface 15 of the movable part 1, which is inclined from top to bottom and from rear to front. The anterior hollow 13 has the shape of a circle sector and it is defined by an upper edge A'B', a lower edge B'C' in the form of an arc of a circle centered on the point A', this edge extending frontwardly as far as the frontal surface la into which hollow 13 opens. The radius of arc B'C' is equal to that of arc BC of projection 8 provided on base 2 and the center A' of circle sector A'B'C' constituting the hollow 13 is placed so as to coincide with the center A of circle sector ABC which constitutes the projection 8, when the two parts 1, 2 of the front abutment are assembled as is shown in FIG. 8. The rib 12 in the form of an annular segment is defined by an upper edge merged with the lower arc-shaped edge B'C' of hollow 13 and by a lower arc-shaped edge D'E' centered at point A' and having a radius equal to the radius of arc DE constituting the upper edge of circular rib 9 of base 2. The width of the arc-shaped rib 12 is equal to the width b of groove 11 formed on base 2.

The extreme upper surfaces defining the projection 8 and hollow 13 and passing respectively through sides AB and A'B' can extend perpendicularly to the external surfaces *7a* of lateral walls 7 of base 2 and to the internal surface *5a* of the upper part 1 or, according to an alternative, as is shown in the drawing, they can be inclined with respect to these surfaces of an angle less than 90°, so as to constitute dovetailed assemblies. More particularly, projection 8 has, in transverse section, as is shown in FIG. 3, a rectangular trapezoid shape of height c, corresponding to the thickness of projection 8, and which is equal to the depth of hollow 13 of the upper part 1. Projection 8 has an upper surface *8a*, originating from upper side AB, which is inclined downwardly and forms an acute angle with the external surface *7a* of lateral wall 7. As a result, the width of projection 8 at the location where it is attached to the external surface *7a* of lateral wall 7 is less than the width of its surface containing side AB. In the same way, hollow 13 in the form of a circle sector is defined by an upper surface *13a* which is inclined downwardly so that the width of hollow 13 is greater in the bottom of the hollow than in the location of its opening defined between the two ribs 12 and 14.

By molding the upper and lower parts 1, 2 as mentioned above, the aforementioned projections, hollows, and associated surfaces can be conveniently formed unitarily with the remainder of the respective upper and lower parts. Further, by means of the aforementioned configuration, the lower part has upwardly facing surfaces and the upper has downwardly facing surfaces which, together, constitute at least a part of a means for journalling the upper part on the lower part, but which also comprises a means for vertically supporting the upper and lower parts..

Figure 7:
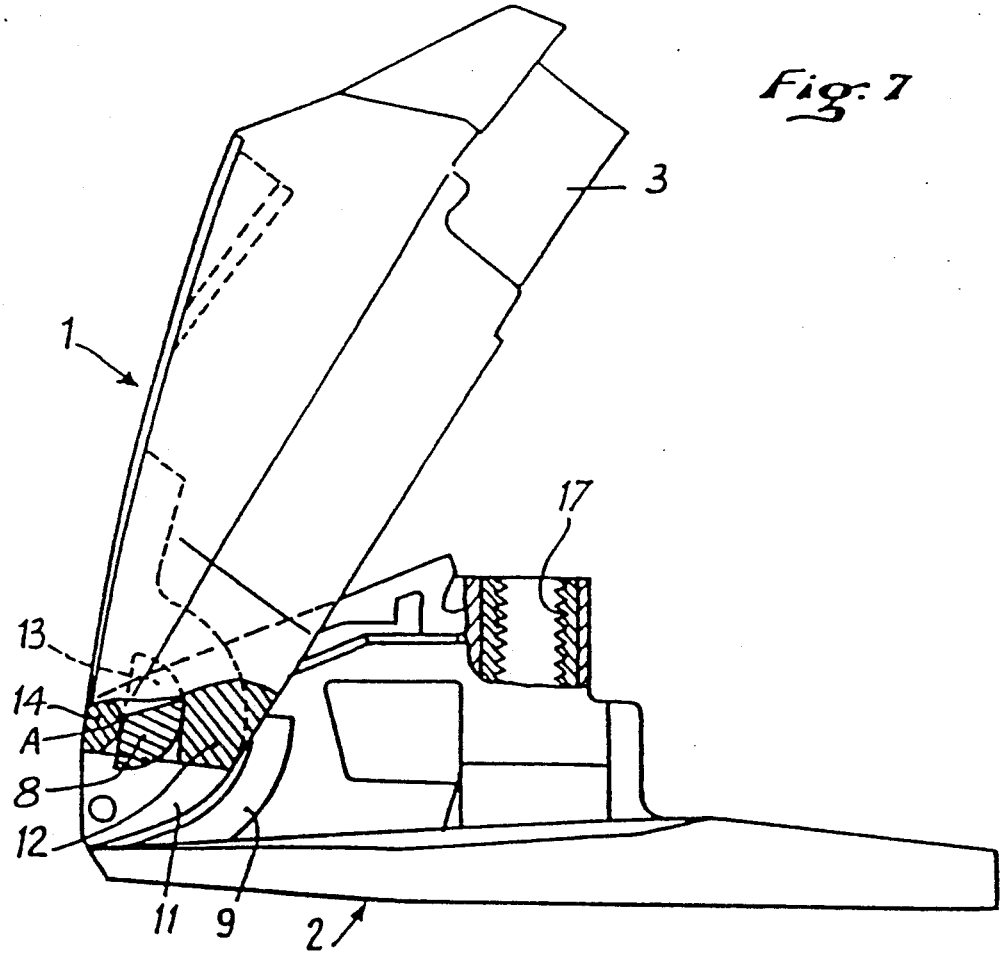
FIGS. 7 and 8 are elevation views of the two parts of the body, at the beginning of the engagement of the upper part in the base and after rotation until the final assembly position, respectively.

To assemble the upper part 1 and lower part 2 of the body of the front abutment, upper part 1 is presented above base 2 as is shown in FIG. 1, so that its longitudinal axis is substantially perpendicular to that of base 2. Then upper part 1 is lowered so as to engage the front of the latter on the front of base 2 as is shown in FIG. 7. Projection 8 is then engaged in hollow 13, while the extreme lower part of rib 12 is engaged in the extreme upper part of groove 11 of base 2. Then, upper part 1 is pivoted with respect to base 2, in a clockwise direction, to bring it into its final assembly position shown in FIG. 8, in which the longitudinal axis of upper part 1 is substantially parallel to that of base 2. In the course of this movement, the upper part 1 turns around projection 8 constituting a sort of pivot and the rib 12 of the upper part 1 engages progressively in the circular groove 11 which has the same width and the same radius of curvature as rib 12. By this maneuver, latching is achieved between the projecting and hollow elements, of complementary shapes, provided on the two parts 1, 2. This maneuver makes it possible to likewise achieve the coupling between the movable element or elements of jaw 3 supported by the upper part 1 and the force transmission element forming part of the energization mechanism lodged in base 2.

To render the upper part 1 and base 2 of the body inseparable, their linkage is ensured by means of a height adjustment screw 15 vertically extending through a notch 16, open towards the front, formed in the upper part 1 of the body and screwed into a vertical tapped hole 17 formed in a vertical bushing 18 mounted in base 2. Screw 15 includes an upper head *15a* and a lower collar *15b* engaged, respectively, above and below a wall *16a* in the lower portion of notch 16. As a result, screw 15, which is retained vertically and laterally as soon as it is screwed into hole 17, makes it possible, by screwing it more or less, to vary the inclination angle of the upper part 1 with respect to base 2 and, consequently, the height of the jaw 3 with respect to the base.

In final position, as is shown in FIG. 8, the two parts 1, 2 of the body are assembled between them in the front, because of the mutual latching of the hollow and projecting elements provided on the two parts 1, 2 and, at the rear, by the height adjustment screw 15. The only movement allowed then for the upper part 1 is a rotation movement about the imaginary horizontal and transverse axis passing through the merged centers A, A' of projections 8 and hollows 13 in the form of a circle sector. For any other movements, there is a total interdependence between the two parts 1, 2 of the body.

The dismounting of the two parts 1, 2 is carried out by operations in the reverse direction, after removal of the height adjustment screw 15.

Although in the preceding description it has been indicated that each lateral wall 7 of the base supports, on its external lateral surface *7a*, an upper projection 8 in the form of a circle sector and a lower arc-shaped rib 9 defining between them a groove 11, and that each lateral arm 5 of the movable upper part 1 has, on its internal surface *5a*, an upper hollow 13 and a lower arc-shaped rib 12, the reverse arrangement could be adopted, i.e., there could be provided, on the front of each internal surface *5a* of upper part 1 an upper projection in the form of a circle sector, similar to projection 8, and a lower arc-shaped rib, similar to rib 9, defining between them a groove in the form of an annular segment similar to the groove 11 and by providing correlatively on the external surface *7a* facing base 2, a hollow similar to hollow 13 and an arc-shaped rib similar to arc-shaped rib 12.

In the same way, in the preceding description the lower part or base 2 engages, in front, between two arms 5 of the movable upper part 1. However, the invention could likewise apply to a front abutment mounted in the reverse, i.e., in which the movable upper part 1 would be engaged between two lateral and vertical arms of lower part 2. In this case, the projecting and hollow elements, whose mutual nesting ensures the actualization of imaginary journal axis A, would be provided on the external surfaces of the lateral walls of upper part 1 and on the internal surfaces of the lateral arms of lower part 2.

What is claimed is:

1. Safety ski binding adapted to hold the front of a boot mounted on a ski, comprising:

(a) a jaw adapted to engage a portion of the boot and adapted to be biased to a predetermined position by means of a biasing mechanism comprised of a spring and an element for transmitting force from the spring to said jaw; and (b) a body comprising:

a lower part adapted to be affixed to the ski and having a front end and a rear end;

an upper part having a front end and a rear end, said jaw being supported by said rear end of said upper part, said upper part being movable with respect to said lower part about a generally horizontal transverse axis extending through said front end of said lower part and said front end of said upper part, one of said lower part and said upper part comprising a single member through which a longitudinal axis of the binding extends, and the other of said lower part and said upper part having a pair of laterally spaced arms for receiving said single member of said one of said lower part and said upper part; and means for journalling said front end of said upper part to said front end of said lower part for relative movement about said transverse axis, said means for journalling including respective generally vertical surfaces of said upper part and said lower part being positioned laterally adjacent each other, wherein projecting portions and hollow portions, having respective complementary shapes for respective engagement with one another, extend from and are unitary with said respective vertical surfaces of said upper part and said lower part of said body.

2. Safety ski binding according to claim 1, wherein said projecting portions and said hollow portions include, (1) on one of said upper part and said lower part of said body, (A) a projection in the form of a sector of a circle, generally centered on said axis, said sector thereby having a radius of curvature and an arc of said circle, said projection thereby having an arc-shaped edge, and (B) a first arc-shaped rib in the form of an annular segment having an average radius greater than said radius of said sector and generally centered on said axis, so as to define between said first arc-shaped rib and said projection a first groove in the form of an annular segment, generally centered on said axis, and, (2) on the other of said upper part and said lower part of said body, (A) a second arc-shaped rib in the form of an annular segment generally having the same width and radius as said first groove, said second arc-shaped rib being generally centered on said axis, and (B) an upper hollow in the form of a sector of a circle, complementary in shape to said projection, defined by said second arc-shaped rib and generally centered on said axis.

3. Safety ski binding according to claim 2, wherein said first arc-shaped rib is positioned beneath said projection and wherein said second arc-shaped rib is positioned beneath said hollow.

4. Safety ski binding according to claim 3, wherein said projection and said hollow have upper surfaces which extend generally perpendicularly from said generally vertical surfaces of said upper part and said lower part of said body.

5. Safety ski binding according to claim 3, wherein said projection and said hollow have upper surfaces which extend at an angle less than 90° from said generally vertical surfaces of said upper part and said lower part of said body so as to constitute dovetailed assemblies.

6. Safety ski binding according to claim 3, wherein said projection includes, in elevation, (1) an upper rectilinear side inclined upwardly and rearwardly with respect to the horizontal, (2) a lower side comprising said arc-shaped edge of said projection, said arc-shaped edge extending over an angle of approximately 120°, downwardly and frontwardly, and (3) a front side which is inclined upwardly and frontwardly, and forming an angle of approximately 20 ° with respect to the vertical, and said first arc-shaped rib having an upper surface facing said upper projection, said upper surface of said first arc-shaped rib being constituted by an arc of a circle which is generally centered at said axis and which extends over an angle slightly less than 90°, said arc of said circle of said first arc-shaped rib having ana upper extremity located substantially at a height substantially the same as said axis and offset rearwardly from said axis, and wherein said arc of said circle of said first arc-shaped rib has a lower extremity located slightly rearwardly of a vertical plane passing through said axis.

7. Safety ski binding according to claim 4, wherein said projection includes, in elevation, (1) an upper rectilinear side inclined upwardly and rearwardly with respect to the horizontal, (2) a lower side comprising said arc-shaped edge of said projection, said arc-shaped edge extending over an angle of approximately 120°, downwardly and frontwardly, and (C) a front side which is inclined upwardly and frontwardly, and forming an angle of approximately 20 ° with respect to the vertical, and said first arc-shaped rib having an upper surface facing said upper projection, said upper surface of said first arc-shaped rib being constituted by an arc of a circle which is generally centered at said axis and which extends over an angle slightly less than 90°, said arc of said circle of said first arc-shaped rib having an upper extremity located substantially at a height substantially the same as said axis and offset rearwardly from said axis, and wherein said arc of said circle of said fist arc-shaped rib has a lower extremity located slightly rearwardly of a vertical plane passing through said axis.

8. Safety ski binding according to claim 5, wherein said projection includes, in elevation, (1) an upper rectilinear side inclined upwardly and rearwardly with respect to the horizontal, (2) a lower side comprising said arc-shaped edge of said projection, said arc-shaped edge extending over an angle of approximately 120°, downwardly and frontwardly, and (C) a front side which is inclined upwardly and frontwardly, and forming an angle of approximately 20 °with respect to the vertical, and said first arc-shaped rib having an upper surface facing said upper projection, said upper surface of said first arc-shaped rib being constituted by an arc of a circle which is generally centered at said axis and which extends over an angle slightly less than 90°, said arc of said circle of said fist arc-shaped rib having an upper extremity located substantially at a height substantially the same as said axis and offset rearwardly from said axis, and wherein said arc of said circle of said first arc-shaped rib has a lower extremity located slightly rearwardly of a vertical plane passing through said axis.

9. Safety ski binding according to claim 3, wherein said hollow includes, in elevation, an upper rectilinear edge, a lower edge in the form of an arc of a circle having a center generally at said axis, said edge extending to a frontal surface of one of said upper part and said lower part of said body into which said hollow opens, said arc of said lower edge of said upper hollow having a radius of curvature generally equal to said radius of said arc of said sector of said circle of said projection, wherein said circle of said arc of said lower edge of said hollow has a center which is positioned so as to generally coincide with said center of said circle of said arc of said lower edge of said projection when said upper part and said lower part of said body are assembled, and wherein said second arc-shaped rib is defined by an upper edge merged with said lower arc-shaped edge of said hollow and by a lower arc-shaped edge having a center of curvature generally at said axis and having a radius of curvature generally equal to the radius of curvature of said arc constituting the upper edge of said first arc-shaped rib.

10. Safety ski binding according to claim 4, wherein said hollow includes, in elevation, an upper rectilinear edge, a lower edge in the form of an arc of a circle having a center generally at said axis, said edge extending to a frontal surface of one of said upper part and said lower part of said body into which said hollow opens, said arc of said lower edge of said upper hollow having a radius of curvature generally equal to said radius of said arc of said sector of said circle of said projection, wherein said circle of said arc of said lower edge of said hollow has a center which is positioned so as to generally coincide with said center of si circle of said arc of said lower edge of said projection when said upper part and said lower part of said body are assembled, and wherein said second arc-shaped rib is defined by an upper edge merged with said lower arc-shaped edge of said hollow and by a lower arc-shaped edge having a center of curvature generally at said axis and having a radius of curvature generally equal to the radius of curvature of said arc constituting the upper edge of said first arc-shaped rib.

11. Safety ski binding according to claim 5, wherein said hollow includes, in elevation, an upper rectilinear edge, a lower edge in the form of an arc of a circle having a center generally at said axis, said edge extending to a frontal surface of one of said upper part and said lower part of said body into which said hollow opens, said arc of said lower edge of said upper hollow having a radius of curvature generally equal to said radius of said arc of said sector of said circle of said projection, wherein said circle of said arc of said lower edge of said hollow has a center which is positioned so as to generally coincide with said center of said circle of said arc of said lower edge of said projection when said upper part and said lower part of said body are assembled, and wherein said second arc-shaped rib is defined by an upper edge merged with said lower arc-shaped edge of said hollow and by a lower arc-shaped edge having a center of curvature generally at said axis and having a radius of curvature generally equal to the radius of curvature of said arc constituting the upper edge of said first arc-shaped rib.

12. Safety ski binding according to claim 6, wherein said hollow includes, in elevation, an upper rectilinear edge, a lower edge in the form of an arc of a circle having a center generally at said axis, said edge extending to a frontal surface of one of said upper part and said lower part of said body into which said hollow opens, aid arc of said lower edge of said upper hollow having a radius of curvature generally equal to said radius of said arc of said sector of said circle of said projection, wherein said circle of said arc of said lower edge of said hollow has a center which is positioned so as to generally coincide with said center of said circle of said arc of said lower edge of said projection when said upper part and said lower part of said body are assembled, and wherein said second arc-shaped rib is defined by an upper edge merged with said lower arc-shaped edge of said hollow and by a lower arc-shaped edge having a center of curvature generally at said axis and having a radius of curvature generally equal to the radius of curvature of said arc constituting the upper edge of said first arc-shaped rib.

13. Safety ski binding according to claim 7, wherein said hollow includes, in elevation, an upper rectilinear edge, a lower edge in the form of an arc of a circle having a center generally at said axis, said edge extending to a frontal surface of one of said upper part and said lower part of said body into which said hollow opens, said arc of said lower edge of said upper hollow having a radius of curvature generally equal to said radius of said arc of said sector of said circle of said projection, wherein said circle of said arc of said lower edge of said hollow has a center which is positioned so as to generally coincide with said center of said circle of said arc of said lower edge of said projection when said upper part and said lower part of said body are assembled, and wherein said second arc-shaped rib is defined by an upper edge merged with said lower arc-shaped edge of said hollow and by a lower arc-shaped edge having a center of curvature generally at said axis and having a radius of curvature generally equal to the radius of curvature of said arc constituting the upper edge of said first arc-shaped rib.

14. Safety ski binding according to claim 8, wherein said hollow includes, in elevation, an upper rectilinear edge, a lower edge in the form of an arc of a circle having a center generally at said axis, said edge extending to a frontal surface of one of said upper part and said lower part of said body into which said hollow opens, said arc of said lower edge of said upper hollow having a radius of curvature generally equal to said radius of said arc of said sector of said circle of said projection, wherein said circle of said arc of said lower edge of said hollow has a center which is positioned so as to generally coincide with id center of said circle of said arc of said lower edge of said projection when said upper part and said lower part of said body are assembled, and wherein said second arc-shaped rib is defined by an upper edge merged with said lower arc-shaped edge of said hollow and by a lower arc-shaped edge having center of curvature generally at said axis and having a radius of curvature generally equal to the radius of curvature of said arc constituting the upper edge of said first arc-shaped rib.

15. A ski binding adapted to hold an end of a boot upon a ski, said binding comprising:

(a) a jaw; and (b) a body comprising:

a lower part adapted to be affixed to the ski and having a first end, a second end, and a longitudinal axis, said lower part further having an upwardly facing surface extending upwardly and toward said second end;

an upper part, said upper part having a first end, a second end, and a longitudinal axis, said jaw being supported at said second end of said upper part, said upper part having a downwardly facing surface for being positioned adjacent said upwardly facing surface of said lower part, one of said upper part and said lower part comprising a single member through which said longitudinal axis extends, and the other of said upper part and said lower part having a pair of spaced arms for receiving said single member of said one of said upper part and said lower part; and means for journalling said first end of said upper part to said first end of said lower part, said means for journalling comprising said upwardly facing surface of said lower part and said downwardly facing surface of said upper part which are complementarily arcuately shaped having a common center of curvature, when said upwardly facing surface of said lower part is positioned adjacent said downwardly facing surface of said upper part, for enabling a generally pivotal movement of is upper part with respect to said lower part about said center of curvature.

16. The ski binding of claim 15, wherein said upwardly facing surface of said lower part terminates at location spaced from said center of curvature in a direction toward said second end of said lower part.

17. The ski binding of claim 15, wherein said lower part comprises a generally vertical surface on either side of said longitudinal axis of said lower part, one of said generally vertical surfaces of said lower part having affixed thereto said upwardly facing surface, the other of said generally vertical surfaces of said lower part having affixed thereto another upwardly facing surface, wherein each of sid generally vertical surfaces of said lower part further has affixed thereto a projection, wherein each of said projections is positioned above a respective one of said upwardly facing surface and said another upwardly facing surface to define a respective groove.

18. The ski binding of claim 17, wherein said upper part comprises a generally vertical surface on either side of said longitudinal axis of said upper part, one of said generally vertical surfaces of said upper part having a affixed thereto said downwardly facing surface, the other of said generally vertical surfaces of said upper part having affixed thereto another downwardly facing surface, wherein each of said generally vertical surfaces of said upper part further has a recess therein, wherein each of said recesses is positioned radially inwardly from a respective one of said downwardly facing surfaces toward said center of curvature to thereby define respective arc-shaped ribs for being slidingly receivable in a respective one of said grooves in said lower part.

19. The ski binding of claim 15, wherein said upper part and said lower part of said body are further coupled by means of a height adjustment screw for selective adjustment of the height of said jaw relative to said ski.

20. The ski binding of claim 18, wherein said generally vertical surfaces of said upper part comprise inner surfaces of said arms, said arms, said arms being parallel and laterally spaced, each of said pair of arms being adapted to be positioned exteriorly of respective generally vertical surfaces of said lower part and to slide relative thereto during said general pivoting movement of said upper part with respect to said lower part.

21. The ski binding of claim 18, wherein each of said projections and said recesses have complementarily shaped arcuate surfaces generally centered at said center of curvature.

22. The ski binding of claim 17, wherein each of said projections extend transversely from a respective generally vertical surface and ends in a widened portion.

23. The ski binding of claim 18, wherein each of said projections extend transversely outwardly from a respective generally vertical surface and ends in a widened portion, and wherein each of said recesses extend transversely inwardly from a respective generally vertical surface and ends in a widened portion for receiving a respective widened portion of a respective one of said projections.

24. The ski binding of claim 15, said upwardly facing surface of said lower part and said downwardly facing surface of said upper part comprising means for vertically supporting said upper part on said lower part.

25. The ski binding of claim 15, wherein said upwardly facing surface of said lower part forms the lower surface of a groove, wherein said downwardly facing surface of said upper part forms the lower surface of a rib for complementary engagement within said groove, whereby said upper part and said lower part are adapted to be assembled by means of the joining of said upper part and said lower part in a movement parallel to a plane within which said pivotal movement of said upper part occurs.

26. A ski binding adapted to hold the front of a boot mounted on a ski, comprising:

(a) a jaw adapted to engage a portion of the boot and adapted to be biased to a predetermined position by means of a biasing mechanism comprised of a spring and an element for transmitting force from the spring to said jaw; and (b) a body comprising:

a lower part adapted to be affixed to the ski and having a front end and a rear end;

an upper part having a front end and a rear end, said jaw being supported by said rear end of said upper part, si upper part being movable with respect to said lower part about a generally horizontal transverse axis extending through said front end of said lower part and said front end of said upper part, one of said lower part and said upper part comprising a single member through which a longitudinal axis of the binding extends, and the other of said lower part and said upper part having a pair of laterally spaced arms for receiving said single member of said one of said lower part and said upper part; and means for journalling said front end of said upper part to said front end of said lower part for relative movement about said transverse said, said means for journalling including respective generally vertical surfaces of said upper part and said lower part being positioned laterally adjacent each other, wherein said respective vertical surfaces of said upper part and said lower part of said body support projecting portions and hollow portions having respective complementary shapes for respective engagement with one another, said projecting portions having arcuate surfaces with respective transverse cross-sections in the shape of part of a circle.

27. The ski binding of claim 26, each of said lower part and said upper part being formed as a respective molded piece.

28. A ski binding adapted to hold an end of a boot upon a ski, said binding comprising:

(a) a jaw; and (b) a body comprising:

a lower part adapted to be affixed to the ski and having a first end, a second end, and a longitudinal axis, said lower part further having an upwardly facing surface extending upwardly and toward said second end;

an upper part, said upper part having a first end, a second end, and a longitudinal axis, said jaw being supported by said second end of said upper part, said upper part having a downwardly facing surface which is slidably engageable with said upwardly facing surface of said lower part, one of said upper part and said lower part comprising a single member through which said longitudinal axis extends, and the other of said upper part and said lower part having a pair of spaced arms for receiving said single member of said one of said upper part and said lower part; and means for journalling said first end of said upper part to said first end of said lower part, said means for journalling comprising said upwardly facing surface of said lower part and said downwardly facing surface of said upper part, said upwardly facing surface of said lower part and said downwardly facing surface of said upper part being complementarily arcuately shaped and having a common center of curvature, when said upwardly facing surface of said lower part is engaged with said downwardly facing surface of said upper part, for enabling a generally pivotal movement of said upper part with respect to said lower part about said center of curvature.

29. The ski binding of claim 28, each of said lower part and said upper part being formed as a respective molded piece.

30. The ski binding of claim 28, said lower part comprising a pair of laterally spaced upwardly facing surfaces and said upper part comprising a pair of laterally spaced downwardly facing surfaces which slidably engage respective ones of said laterally spaced upwardly facing surfaces.

31. A safety ski binding adapted to hold the front of a boot mounted on a ski, comprising:

(a) a jaw adapted to engage a portion of the boot; and (b) a body comprising:

(i) a lower part adapted to be affixed to the ski and having a front end, a lower end, and a pair of opposed generally vertical surfaces; and (ii) an upper part supporting said jaw and having a front end, a rear end, and a pair of opposed generally vertical surfaces, said upper part being movable with respect to said lower part about a generally horizontal transverse axis extending through said front end of said lower part and said front end of said upper part.

wherein respective portions of said upper part and said lower part are nested with respect to one another by means of respective ones of said generally vertical surfaces of said lower part being received between said vertical surfaces of said upper part and being laterally adjacent each other, wherein first respective ones of said vertical surfaces of said upper part and said lower part of said body include a projection in the from of a sector of a circle and a first arc-shaped rib in the form of an annular segment, and second respective ones of said vertical surfaces of said upper part and said lower part of said body include a second arc-shaped rib in the form of an annular segment and an upper hollow in the form of a sector of a circle, wherein said projections, said first arc-shaped ribs, said second arc-shaped ribs, and said upper hollows are shaped for interfitting engagement with one another.

* * * * *